US011359437B2

(12) United States Patent
Slate

(10) Patent No.: US 11,359,437 B2
(45) Date of Patent: Jun. 14, 2022

(54) LADDER CADDY ASSEMBLY

(71) Applicant: Donald Slate, Chino Valley, AZ (US)

(72) Inventor: Donald Slate, Chino Valley, AZ (US)

( * ) Notice: Subject to any disclaimer, the term of this patent is extended or adjusted under 35 U.S.C. 154(b) by 330 days.

(21) Appl. No.: 16/669,619

(22) Filed: Oct. 31, 2019

(65) Prior Publication Data

US 2021/0131182 A1 May 6, 2021

(51) Int. Cl.

| | |
|---|---|
| ***E06C 7/14*** | (2006.01) |
| ***B25H 3/06*** | (2006.01) |
| ***B25H 3/02*** | (2006.01) |

(52) U.S. Cl.

CPC ..... *E06C 7/14* (2013.01); *B25H 3/021* (2013.01); *B25H 3/06* (2013.01)

(58) Field of Classification Search

CPC .. E06C 7/14; B25H 3/021; B25H 3/06; B25H 3/02

USPC ..... 248/210, 238, 211; 182/129

See application file for complete search history.

(56) References Cited

U.S. PATENT DOCUMENTS

| | | | | | |
|---|---|---|---|---|---|
| 4,653,713 | A | | 3/1987 | Hamilton | |
| D329,135 | S | | 9/1992 | Embree | |
| 5,370,263 | A | * | 12/1994 | Brown | B25H 3/06 206/373 |
| D361,664 | S | * | 8/1995 | Brown | D3/315 |
| 5,460,305 | A | | 10/1995 | Ahearn | |
| 5,782,314 | A | * | 7/1998 | Zeitler | E06C 7/14 182/129 |
| 5,799,819 | A | * | 9/1998 | Nimer | B44D 3/14 220/481 |
| 5,873,433 | A | * | 2/1999 | Katz | E06C 7/14 182/129 |
| 5,899,296 | A | * | 5/1999 | Lantz | E06C 7/48 182/214 |
| 5,941,344 | A | * | 8/1999 | Spadaro | E06C 7/14 182/129 |
| 6,095,057 | A | | 8/2000 | Corban | |
| 6,267,277 | B1 | | 7/2001 | Taylor | |
| 6,516,948 | B1 | | 2/2003 | Caballero | |
| D516,227 | S | * | 2/2006 | Price | D25/68 |
| 7,032,711 | B1 | * | 4/2006 | Katz | B25H 3/06 182/129 |
| 7,059,692 | B2 | | 6/2006 | Glenn | |
| 7,063,187 | B1 | * | 6/2006 | Lavigne | E06C 1/39 182/129 |
| 7,264,084 | B1 | * | 9/2007 | Switzer | E06C 7/14 182/129 |
| 7,370,726 | B1 | * | 5/2008 | Chavez | E06C 1/18 182/129 |
| 8,596,454 | B1 | * | 12/2013 | Carlson | E06C 7/14 206/373 |
| 8,636,144 | B1 | * | 1/2014 | Lawery | E06C 7/14 206/234 |

(Continued)

*Primary Examiner* — Kimberly T Wood

(57) ABSTRACT

A ladder caddy assembly includes a box that has a sloped side that is positionable against a back set of legs of a folding ladder when the folding ladder is deployed. A mount is coupled to the box and the mount comprises a leg and a foot. The leg rests on a top step of the ladder for retaining the box on the ladder. The foot rests against a front set of legs of the ladder to inhibit the box from sliding away from the ladder. A pair of stops is each coupled to the box. Each of the stops abuts against the back legs of the ladder thereby inhibiting the box from sliding laterally off of the ladder.

1 Claim, 5 Drawing Sheets

(56) References Cited

U.S. PATENT DOCUMENTS 8,925,685 B2 * 1/2015 Dufour ..... E04G 5/003 182/129
9,359,819 B1 * 6/2016 Valadez ..... E06C 7/14
9,428,958 B1 * 8/2016 Ellis ..... B25H 3/06
9,714,542 B1 * 7/2017 Harcz ..... E06C 7/14
D875,970 S * 2/2020 Heffernan ..... D25/68
2006/0042876 A1 * 3/2006 Angotti ..... E06C 7/14 182/129
2006/0169537 A1 * 8/2006 Enochs ..... E04G 5/003 182/129
2006/0192063 A1 * 8/2006 Angotti ..... E06C 7/14 248/210
2007/0062839 A1 * 3/2007 Patterson ..... B65D 25/06 206/523
2007/0187184 A1 8/2007 Nasuti
2009/0032662 A1 * 2/2009 Parrott ..... E06C 7/14 248/238
2010/0155177 A1 * 6/2010 Tydings, III ..... B25H 3/06 182/129
2011/0168493 A1 * 7/2011 Clark ..... E06C 7/14 182/129
2012/0103726 A1 * 5/2012 Morfidis ..... E06C 7/50 182/129
2012/0217093 A1 * 8/2012 Latimer ..... E06C 1/18 182/129
2012/0266436 A1 * 10/2012 Rittmann ..... E06C 7/48 29/428
2012/0325992 A1 12/2012 Keshock
2013/0161217 A1 * 6/2013 Whalen ..... A45C 11/00 206/349
2014/0224703 A1 * 8/2014 Valenti ..... E06C 7/14 206/557
2016/0153235 A1 * 6/2016 Villar ..... E06C 7/14 220/475
2017/0058602 A1 * 3/2017 Cureton ..... E06C 7/14
2017/0089135 A1 * 3/2017 Heffernan ..... E04G 5/003

* cited by examiner

LADDER CADDY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to caddy devices and more particularly pertains to a new caddy device for storing tools and objects on a folding ladder.

(2) Description of Related Art Including Information Disclosed Under 37 CFR 1.97 and 1.98

The prior art relates to caddy devices.

BRIEF SUMMARY OF THE INVENTION

An embodiment of the disclosure meets the needs presented above by generally comprising a box that has a sloped side that is positionable against a back set of legs of a folding ladder when the folding ladder is deployed. A mount is coupled to the box and the mount comprises a leg and a foot. The leg rests on a top step of the ladder for retaining the box on the ladder. The foot rests against a front set of legs of the ladder to inhibit the box from sliding away from the ladder. A pair of stops is each coupled to the box. Each of the stops abuts against the back legs of the ladder thereby inhibiting the box from sliding laterally off of the ladder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
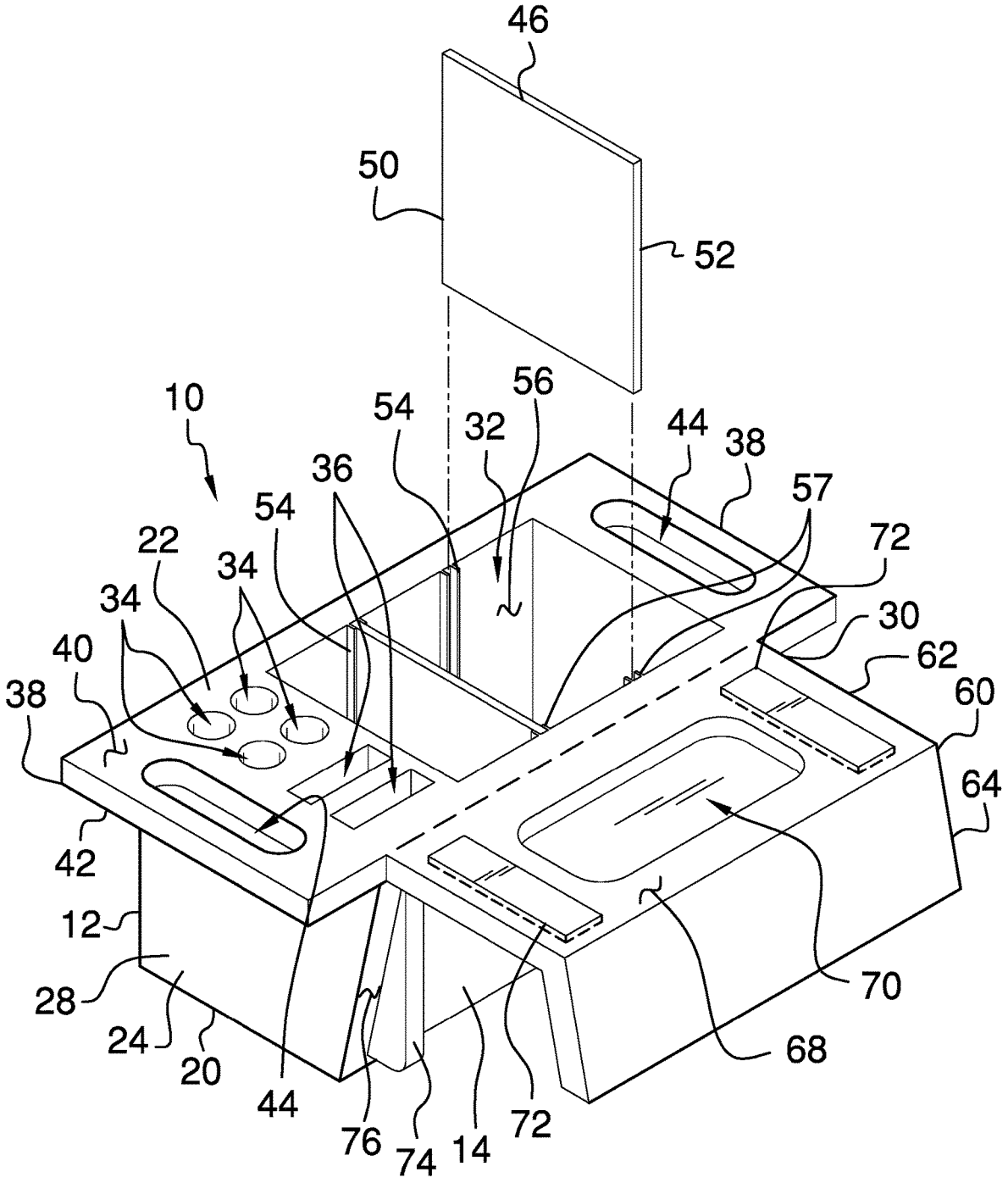
FIG. 1 is a top perspective view of a ladder caddy assembly according to an embodiment of the disclosure.
Figure 2:
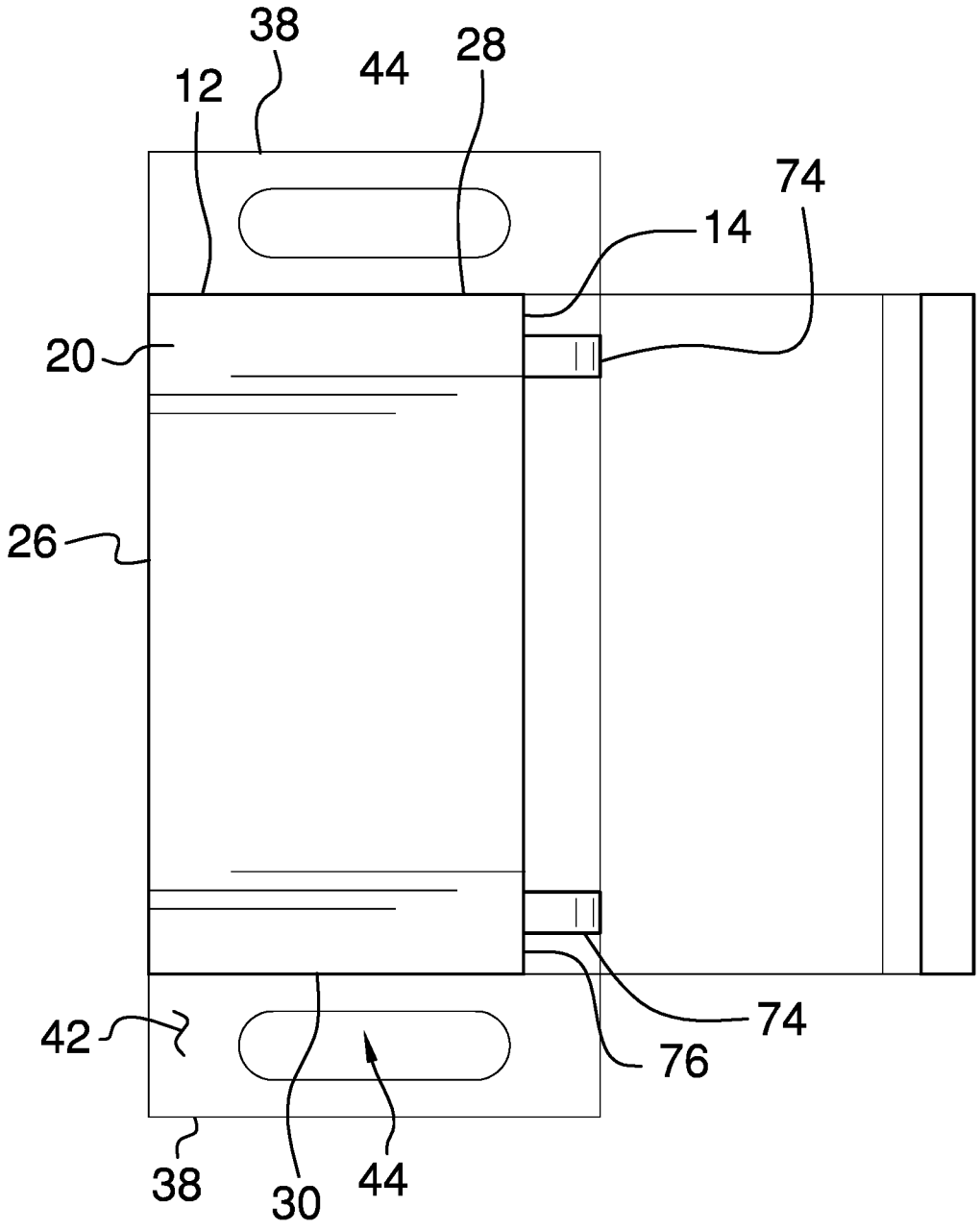
FIG. 2 is a bottom view of an embodiment of the disclosure.
Figure 3:
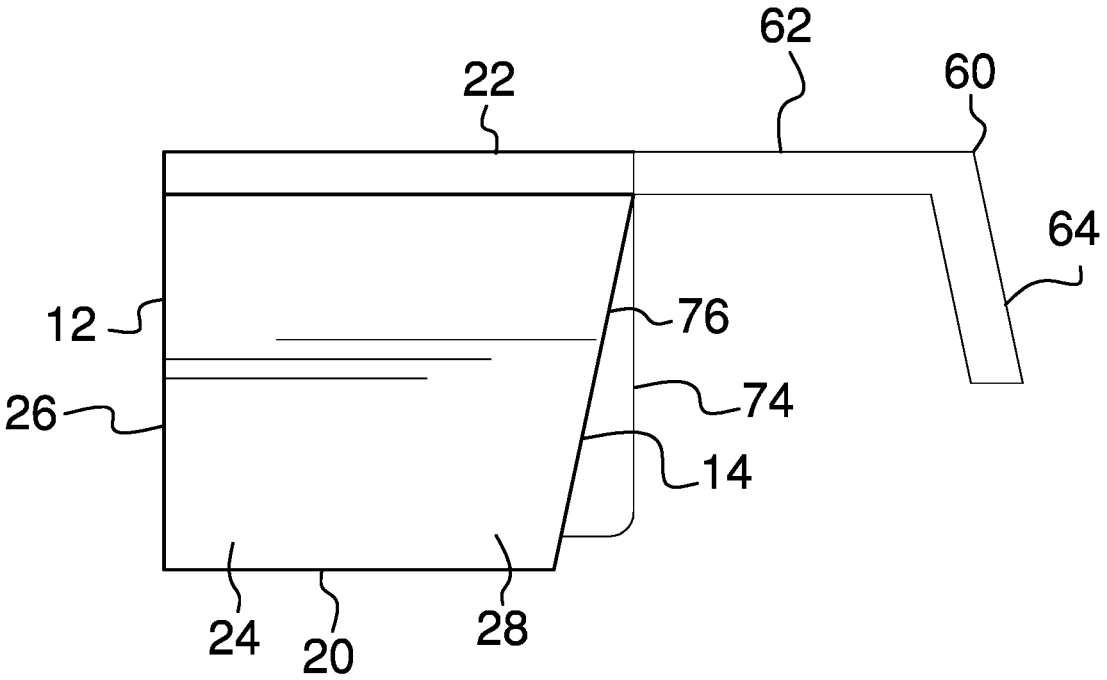
FIG. 3 is a left side view of an embodiment of the disclosure.
Figure 4:
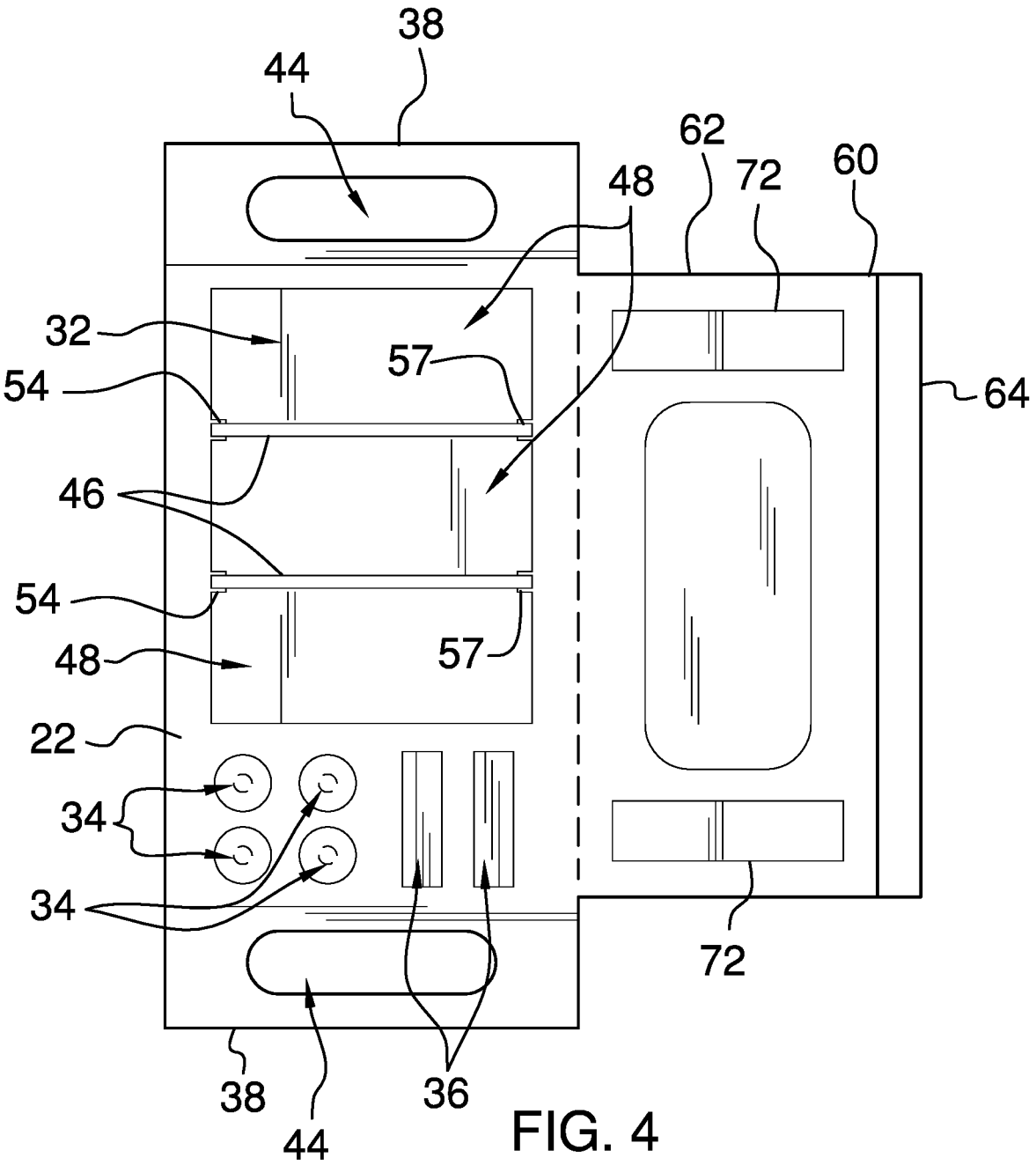
FIG. 4 is a top view of an embodiment of the disclosure.
Figure 5:
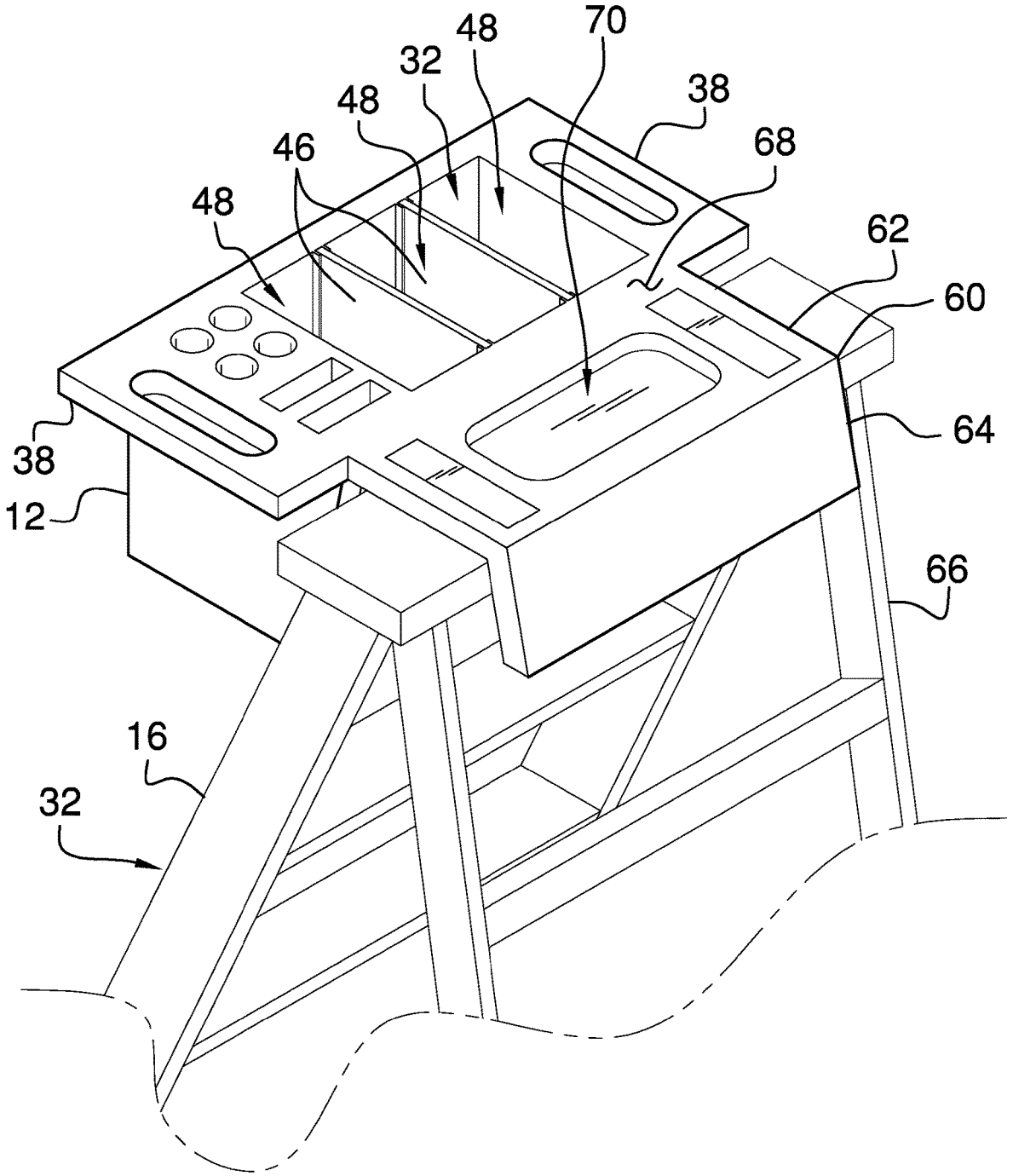
FIG. 5 is a perspective in-use view of an embodiment of the disclosure.

With reference now to the drawings, and in particular to FIGS. 1 through 5 thereof, a new caddy device embodying the principles and concepts of an embodiment of the disclosure and generally designated by the reference numeral 10 will be described.

As best illustrated in FIGS. 1 through 5, the ladder caddy assembly 10 generally comprises a box 12 that has a sloped side 14 that is positionable against a back set of legs 16 of a folding ladder 18 when the folding ladder 18 is deployed. The box 12 has a basal wall 20, a top wall 22 and an outer wall 24 extending therebetween. The outer wall 24 has a front side 26, a first lateral side 28, a second lateral side 30 and the sloped side 14. The top wall 22 has a primary opening 32 extending into an interior of the box 12 for storing objects.

The top wall 22 has a plurality of apertures 34 each extending into the interior of the box 12 to insertably receive an elongated tool, such as a screwdriver or the like, for storage. Each of the apertures 34 is positioned between the first lateral side 28 of the outer wall 24 and the primary opening 32. The top wall 22 has a plurality of the secondary openings 36 each extending into the interior of the box 12 to insertably receive an elongated tool for storage. Each of the secondary openings 36 is positioned between the first lateral side 28 of the outer wall 24 and the primary opening 32. Additionally, each of the secondary openings 36 is elongated and may have a rectangular shape.

The sloped side 14 angles outwardly between the basal wall 20 and the top wall 22 such that the top wall 22 has a width that is greater than a width of the basal wall 20. The box 12 includes pair of wings 38 and each of the wings 38 extends away from a respective one of the first lateral side 28 and the second lateral side 30 of the outer wall 24 of the box 12. Each of the wings 38 is aligned with the top wall 22 of the box 12 and each of the wings 38 has a top surface 40 and a bottom surface 42. Additionally, each of the wings 38 has a slot 44 extending through the top surface 40 and the bottom surface 42 for gripping each of the wings 38.

A pair of dividers 46 is provided and each of the dividers 46 is removably positionable in the box 12 for defining a plurality of compartments 48 in the box 12. Each of the dividers 46 has a front edge 50 and a back edge 52. The front edge 50 of each of the dividers 46 slidably engages a respective engagement 54 on an inside surface 56 of the front side 26 of the outer wall 24 of the box 12. The back edge 52 of each of the dividers 46 slidably engages a respective engagement 57 on an inside surface 58 of the sloped side 14 of the outer wall 24 of the box 12.

A mount 60 is coupled to the box 12 and the mount 60 comprises a leg 62 and a foot 64. The leg 62 rests on a top step 61 of the folding ladder 18 for retaining the box 12 on the folding ladder 18. The foot 64 angles away from the leg 62 and the foot 64 rests against a front set of legs 66 of the folding ladder 18. In this way the mount 60 inhibits the box 12 from sliding away from the folding ladder 18. The foot 64 slants away from the sloped side 14 of the outer wall 24 of the box 12. The leg 62 has an upper surface 68 and the upper surface 68 has a well 70 extending downwardly therein for storing objects.

A pair of magnets 72 is each coupled to the leg 62 of the mount 60. Each of the magnets 72 magnetically engages metallic objects, such as nails, screws or other loose objects, for storage. Each of the magnets 72 is positioned on the upper surface 68 of the leg 62. Additionally, each of the magnets 72 is positioned on opposite sides of the well 70 from each other.

A pair of stops 74 is provided and each of the stops 74 is coupled to the box 12. Each of the stops 74 is positioned on the sloped side 14 of the box 12. Additionally, each of the stops 74 abuts against the back legs 66 of the folding ladder 18 thereby inhibiting the box 12 from sliding laterally off of the folding ladder 18. Each of the stops 74 is positioned on an outer surface 76 of the sloped side 14 and each of the stops 74 extends between the basal wall 20 of the box 12 and the leg 62 of the mount 60. Each of the stops 74 is positioned adjacent to a respective one of the first lateral side 28 and the second lateral side 30 of the outer wall 24 of the box 12.

In use, the box 12 and the mount 60 are positioned on top of the folding ladder 18 when the folding ladder 18 is deployed. Thus, tools and other objects can be stored on top of the folding ladder 18. Additionally, each of the stops 74 inhibits the box 12 and the mount 60 from sliding laterally off of the folding ladder 18. Nails, screws or other loose metallic objects can be stored on each of the magnets 72 thereby inhibiting the nails, screws or other loose objects from rolling off of the folding ladder 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ladder caddy assembly being configured to store tools on a top of a ladder, said assembly comprising:

a box having a sloped side being positionable against a back set of legs of a folding ladder when the folding ladder is deployed, said box having a basal wall, a top wall and an outer wall extending therebetween, said outer wall having a front side, a first lateral side, a second lateral side and said sloped side, said top wall having a primary opening extending into an interior of said box for storing objects, said top wall having a plurality of apertures each extending into said interior of said box wherein each of said apertures is configured to insertably receive an elongated tool for storage, each of said apertures being positioned between said first lateral side of said outer wall and said primary opening, said top wall having a plurality of said secondary openings each extending into said interior of said box wherein each of said secondary openings is configured to insertably receive an elongated tool for storage, each of said secondary openings being positioned between said first lateral side of said outer wall and said primary opening, said sloped side angling outwardly between said basal wall and said top wall such that said top wall has a width being greater than a width of said basal wall, said box including pair of wings, each of said wings extending away from a respective one of said first lateral side and said second lateral side of said outer wall of said box, each of said wings being aligned with said top wall of said box, each of said wings having a top surface and a bottom surface, each of said wings having a slot extending through said top surface and said bottom surface for gripping each of said wings;

a pair dividers, each of said dividers being removably positionable in said box for defining a plurality of compartments in said box, each of said dividers having a front edge and a back edge, said front edge of each of said dividers slidably engaging a respective engagement on an inside surface of said front side of said outer wall of said box, said back edge of each of said dividers slidably engaging a respective engagement on an inside surface of said sloped side of said outer wall of said box;

a mount being coupled to said box, said mount comprising a leg and a foot, said leg resting on a top step of the ladder for retaining said box on said ladder, said foot angling away from said leg, said foot resting against a front set of legs of the ladder to inhibit said box from sliding away from the ladder, said foot slanting away from said sloped side of said of said outer wall of said box, said leg having an upper surface, said upper surface having a well extending downwardly therein for storing objects;

a pair of magnets, each of said magnets being coupled to said leg of said mount, each of said magnets magnetically engaging metallic objects for storage, each of said magnets being positioned on said upper surface of said leg, each of said magnets being positioned on opposite sides of said well from each other; and a pair of stops, each of said stops being coupled to said box, each of said stops being positioned on said sloped side of said box, each of said stops abutting against the back legs of the ladder thereby inhibiting said box from sliding laterally off of the ladder, each of said stops being positioned on an outer surface of said sloped side, each of said stops extending between said basal wall of said box and said leg of said mount, each of said stops being positioned adjacent to a respective one of said first lateral side and said second lateral side of said outer wall of said box.

* * * * *